US006095455A

United States Patent [19]

Green

[11] Patent Number: 6,095,455

[45] Date of Patent: Aug. 1, 2000

[54] TAPE ROLL CARRIER

[76] Inventor: David Green, 23575 Via El Recio, Mission Viejo, Calif. 92691

[21] Appl. No.: 09/219,020

[22] Filed: Dec. 23, 1998

[51] Int. Cl.[7] ..... B65D 85/02

[52] U.S. Cl. ..... 242/588.1; 242/588.3; 242/595; 242/597.8; 24/3.12

[58] Field of Search ..... 242/588, 588.1, 242/597.4, 597.5, 404, 404.2, 404.3, 404.1, 597.8, 595, 594.5, 588.3; 24/3.11, 3.12, 3.1; 206/53, 411; 224/162, 163

[56] References Cited

U.S. PATENT DOCUMENTS

| | | | |
|---|---|---|---|
| D. 196,542 | 10/1963 | Zelnick | 224/163 X |
| D. 227,823 | 7/1973 | Boyce | 224/162 X |
| 588,162 | 8/1897 | Moore . | |
| 1,687,731 | 10/1928 | Mittendorf . | |
| 1,818,514 | 8/1931 | Whitaker . | |
| 3,228,618 | 1/1966 | Bracken | 242/597.5 |
| 3,589,634 | 6/1971 | Mason . | |
| 4,046,294 | 9/1977 | Morin . | |
| 4,195,794 | 4/1980 | Ricci et al. . | |
| 4,286,387 | 9/1981 | Di Diego . | |
| 4,531,686 | 7/1985 | Shaw . | |
| 4,536,925 | 8/1985 | Boothe et al. . | |
| 5,358,158 | 10/1994 | Darr . | |
| 5,379,490 | 1/1995 | Wandt et al. . | |
| 5,839,167 | 11/1998 | Wagner . | |
| 5,839,173 | 11/1998 | Otrusina . | |

FOREIGN PATENT DOCUMENTS

| | | | |
|---|---|---|---|
| 390537 | 2/1924 | Germany | 242/597.4 |

*Primary Examiner*—Donald P. Walsh
*Assistant Examiner*—William A. Rivera
*Attorney, Agent, or Firm*—Richard L. Myers

[57] ABSTRACT

A tape roll carrier is adapted for removable attachment to apparel worn by a user. The carrier has a backing plate with a first side and an opposing second side. A support structure extending from the first side is adapted to receive at least one roll of tape. An attachment mechanism fixed to the second side of the backing plate has an open position facilitating attachment to the apparel, and a closed position facilitating firm engagement of the apparel. The support structure can have a hook or basket configuration and may accommodate multiply tape rolls of different width.

4 Claims, 2 Drawing Sheets

TAPE ROLL CARRIER

BACKGROUND OF THE INVENTION

1. Field of the Invention

This invention relates generally to apparatus for carrying a roll of tape, and more specifically, to apparatus for carrying a tape roll on the apparel of a user.

2. Discussion of the Prior Art

Rolls of tape are commonly and frequently used by individuals, particularly trades people such as electricians and painters, who repeatedly perform specific tasks. By way of example, electricians frequently use electrical tape for insulating wire connections. Masking tape is frequently used by painters to isolate areas which are to be left unpainted. In the latter process, the painter must repeatedly reach for the tape roll, remove a suitable length of tape from the roll, set the roll down, and apply the tape to the object. When the roll is not within reach, the painter must move to retrieve it. In order to speed up the process, it is not uncommon to see the painter carry the tape roll in his teeth in order to maintain it in a proximate and accessible location.

SUMMARY OF THE INVENTION

In order to facilitate this process, the present invention provides a carrier which can be attached to apparel of the user, for example, on a belt or the lip of a trouser pocket. The carrier includes a backing plate and a hook which extends from the plate to support the roll of tape. On the opposite side of the backing plate, a clip can be provided to engage the belt or pocket lip of the user.

Multiple hooks can be provided to hold more than one tape roll. The hooks can be appropriately sized to accommodate tape rolls of different width. Alternatively, the hooks can be provided in a telescoping form so that their size is variable by the user. In a further embodiment, a basket can be formed with the backing plate to provide a carrier for the tape roll. The basket can be suitably apertured to coincide with the opening in the center of the tape roll. This will facilitate placement and removal of the tape roll from the basket.

In one aspect of the invention, the tape roll carrier is adapted to be removably attached to apparel worn by a user. The carrier includes a backing plate with a first side and a second opposing side. A support structure, adapted to support at least one roll of tape, is fixed to the backing plate and extends outwardly from the first side of the backing plate. An attachment mechanism is operable relative to the second side of the backing plate to engage the apparel of the user. The attachment mechanism has an open position which facilitates mounting the carrier on the apparel of the user, and is biased to a closed position which holds the carrier in a fixed relationship with the apparel of the user.

In another aspect of the invention, a combination includes an article of apparel adapted to be worn by a user and a tape roll carrier removably attached to the article of apparel. The carrier includes a backing plate having a first side and a second side, and a support structure extending from the first side of the backing plate. An attachment mechanism is fixed to the second side of the backing plate. This mechanism includes at least one jaw movable between an open position facilitating engagement of the article of apparel, and a closed position facilitating a fixed relationship between the backing plate and the article of apparel. The attachment mechanism can include a spring for biasing the jaw to the closed position. The support structure may take the configuration of a container. The backing plate may be either planar or curved to fit a particular body configuration of the user.

These and other features and advantages of the invention will become more apparent with a description of preferred embodiments and reference to the associated drawings.

DESCRIPTION OF THE PREFERRED EMBODIMENTS AND BEST MODE OF THE INVENTION

Figure 1:
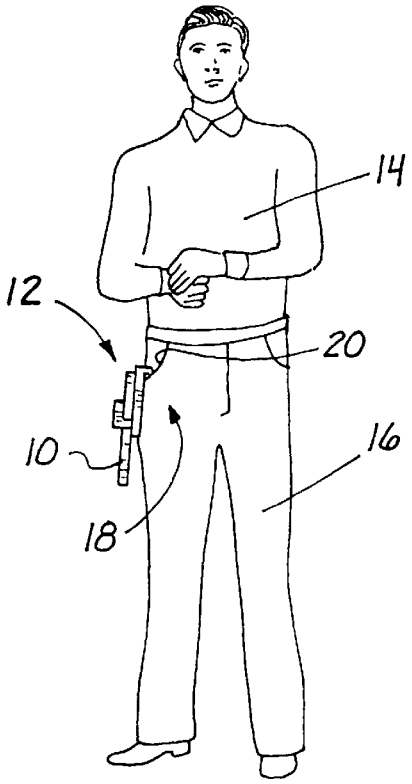
FIG. 1 is a perspective view of a person wearing apparel with a pocket, and a tape roll carrier of the present invention mounted to engage the lip of the pocket.

A roll of tape is illustrated in FIG. 1 and designated generally by the reference numeral 10. The tape roll 10 is removably supported by a carrier 12. A person 14 is shown to be wearing a pair of trousers 16 having hip pocket 18 with a lip 20. The trousers 16 are representative of any piece of apparel which might be worn by a person. Similarly, the hip pocket 18 is representative any pocket formed on the apparel and having a lip, such as the lip 20.

Figure 2:
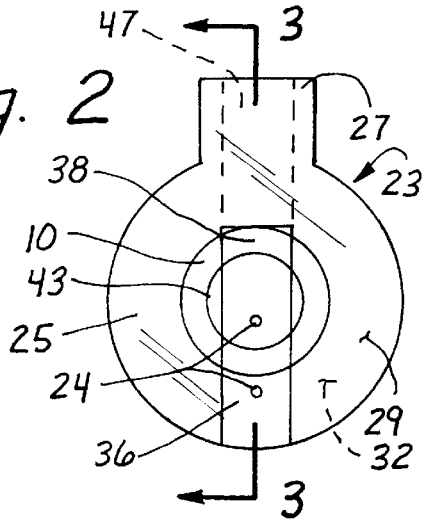
FIG. 2 is a front plan view of the carrier.
Figure 3:
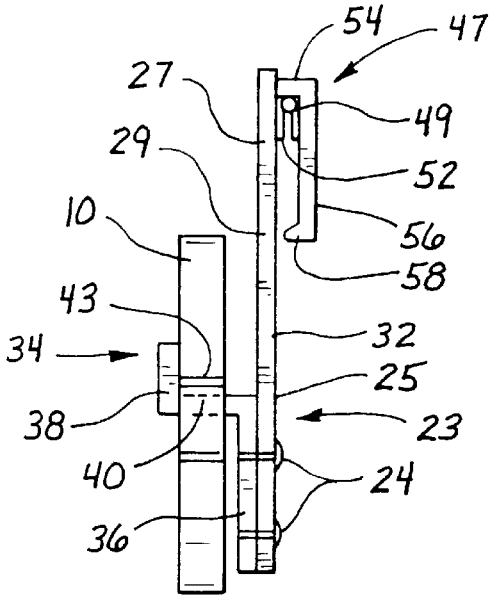
FIG. 3 is a cross-section view taken along lines 3—3 of FIG. 2.

The concept of the carrier 12 is of particular interest to the present invention and includes the embodiment illustrated in FIGS. 2 and 3. This embodiment includes a backing plate 23 which may be generally planar in configuration, or alternatively, may be curved to fit the anatomy of the person 14. The backing plate 23 of this embodiment has a generally round circular portion which forms a backing for the tape roll 10, and a support portion 27 which extends radially from the circular portion 25. The backing plate 23 has a front surface 29 and an opposing rear surface 32. The backing 23 can be formed generally of any solid materials such as wood, plastic or metal. A lighter material such as plastic is used in a preferred embodiment.

A tape support or hook 34 is attached to the backing 25 and extends outwardly of the front surface 29 as best illustrated in FIG. 3. The hook 34 may have an "S" shape with an attachment flange 36, a locking flange 38, and a support flange 40 extending therebetween. In this embodiment, the attachment flange 36 extends along the front surface 29 and is fixed to the backing 25, for example, by a pair of rivets 24. The support flange 40, which may be integral with the attachment flange 36, preferably extends outwardly of the surface 29 to support the tape roll 10. The locking flange 38 may be integral with the attachment and support flanges 36 and 40 respectively, and preferably extends upwardly from the intermediate flange 40. With this configuration, the support flange 40 supports the tape roll 10 between the locking flange 38 and the backing 23.

The tape roll 10 is typically wound on a cylinder 43, best illustrated in FIG. 2 which forms a circular opening at the center of the roll 10. The widths of at least the upper and intermediate flanges 38 and 40 respectively, are preferably less than the diameter of this cylinder 43. The length of the intermediate flange 40, or at least the distance separating the upper and lower flanges 38 and 36 respectively, is greater than the length of the cylinder 43 which is typically equivalent of the width of the tape roll 10.

An attachment mechanism 47 can be provided on the back side of the backing plate 23 to facilitate attachment of the carrier 12 to the apparel, such as the trousers 16, of the person 14. In a preferred embodiment, this attachment mechanism 47 extends from the rear surface 32 of the backing plate 23, and more specifically, from the support portions 27 of the backing plate 23. With this placement, the attachment mechanism 47 can be coupled to the trousers 16 with the backing plate 23 hanging by way of gravity from the attachment mechanism 47.

In the illustrated embodiment, the mechanism 47 includes a clasp which is mounted to the backing plate 23 by a hinge 49 and a spring 52. The mechanism 47 in this case includes a projection flange 54 which is integral with an elongate engagement flange 56 and a terminal lip flange 58. In this case, the projection flange 54 projects outwardly from the rear surface 32 a distance sufficient to provide some spacing between the backing plate 23 and the engagement flange 56. The engagement flange extends from the projection flange downwardly and generally parallel to the backing plate 23. This engagement flange 56 is preferably of a length sufficient to adequately engage the pocket 18 of the trousers 16 or other article of apparel. This length of the engagement flange 56 should be sufficiently long to ensure that the carrier 12 does not become dislodged from the pocket 18. The flange 56 should be sufficiently short that it can be easily removed by the person 14. This attachment and removal is facilitated in a preferred embodiment where the spring 52 biases the attachment mechanism 47 between an open state facilitating engagement of and removal from the lip 20. The spring 52 biases the attachment mechanism 47 to a closed position which firmly holds the pocket 18 between the lip flange 58 and the backing plate 23 when the carrier 12 is operatively positioned. The purpose of the lip flange 58 is to increase the area of contact between the attachment mechanism 47 and the backing plate 23 in order to increase the pressure on the material forming the pocket 18 in this operative position. This lip flange 58 also facilitates attachment of the mechanism 47 to a belt where the flange 58 resists undesirable upward movement which would tend to dislodge the carrier 12.

It will be apparent that many other embodiments of the attachment mechanism 47 will be suitable to removably engage the apparel, such as trousers 16 of the person 14. By way of example, a simple clip can be molded integral with the backing plate 23 and provide a projection which can extend into a pocket 18 or over a belt. In a preferred embodiment, the engagement flange 56 extends in a direction which is opposite to that of the upper flange 38 associated with the hook 34. This ensures that the carrier 12 hangs from the attachment mechanism 47 while facilitating engagement of the tape roll 10 as it hangs from the hook 34.

From the foregoing description, it will be apparent that the hook 34 can take many different shapes and configurations. A "U" shape might be contemplated where both the flanges 36 and 38 extend upwardly with a spacing sufficient to accommodate the tape roll 10. This "U" shape structure would be particularly desirable where it was beneficial to mount the hook 34 near the lower edge of the backing 23.

Figure 4:
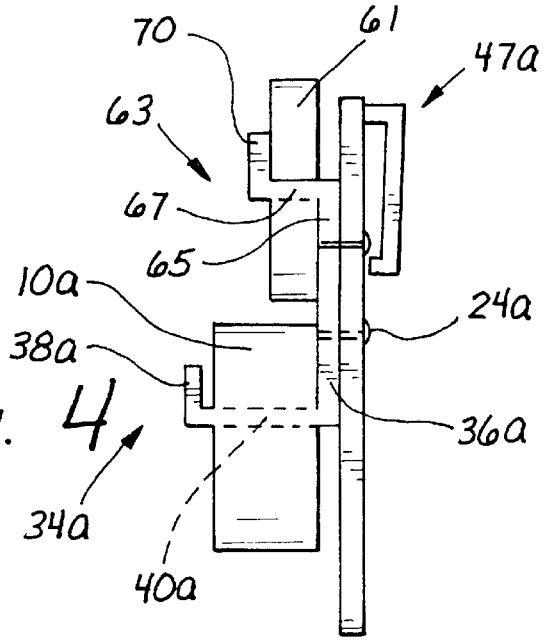
FIG. 4 is a cross-section view similar to FIG. 3 and illustrating another embodiment of the invention.

This "U" shape is shown in a further embodiment illustrated in FIG. 4 where elements of similar structure are designated by the same reference numerals followed by the lower case "a". In this embodiment, the hook 34*a* has the "U" shape configuration and is integral with a second hook 63 which has an "S" shape configuration. This structure is particularly desirable where a second roll of tape 61 is to be carried by the user.

The embodiment of FIG. 4 is particularly adapted to carry multiple rolls of tape such as the tape roll 10*a* and the second tape roll 61. As in the previous embodiment, the tape roll 10*a* can be supported on the hook 34*a* while the second tape roll 61 is supported on the second hook 63. This second hook 63 with the "S" shape, can be similar to that previously discussed with an attachment flange 65, projection flange 67 and locking flange 70.

In this embodiment of FIG. 4, the associated hooks 34*a* and 63 can be varied in size to accommodate different widths for the associated rolls 10*a* and 61. This difference in size is generally accommodated by different lengths of the support flanges 40*a* and 67 which extend from the backing plate 23, distances which are dependent on the associated width of the tape roll. For example, the support flange 40*a* associated with the hook 34 may be slightly longer than two inches in order to accommodate the tape roll 10*a* with a two-inch width. Similarly, the support flange 67 associated with the hook 63 can be provided with a length slightly greater than one inch to accommodate the tape roll 61 with a one-inch width. Where the support flanges 40*a* and 67 are of different length, a preferred embodiment places the shorter flange 67 above the longer flange 40*a* in order to provide greater access to the smaller tape roll 61.

Figure 5:
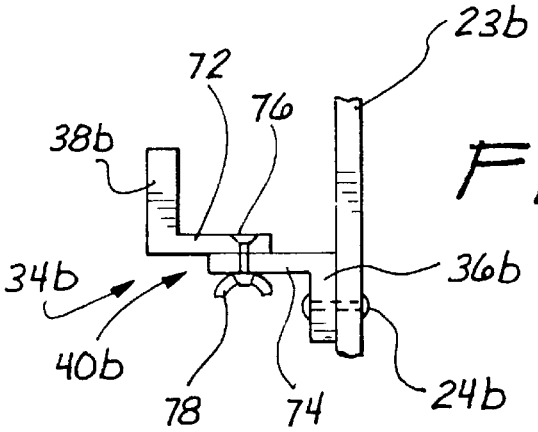
FIG. 5 is a cross-section view similar to FIG. 3 and illustrating still a further embodiment of the invention.

A further embodiment of the invention is illustrated in FIG. 5 where elements of similar structure are designated by the same reference numerals followed by the lower case letter "b". In this figure, for example, the backing plate is designated by the reference numeral 23*b*. In this embodiment, the hook 34*b* is provided with a variable width to accommodate different sizes of tape rolls. The hook 34*b* includes the attachment flange 36*b* and the locking flange 38*b* as previously described. In this embodiment, however, the support flange 40*b* includes two flanges 72 and 74 which are movable relative to each other to define a variable length for the support flange 40*b*. A set screw 76 and wing nut 78 can be used to hold the flanges 72 and 74 in a predetermined, fixed orientation. This arrangement for the flange 40*b* provides for variation in the spacing between the locking flange 38*b* and the backing plate 23*b*. With this variable relationship, different widths of the tape roll can be accommodated.

Figure 6:
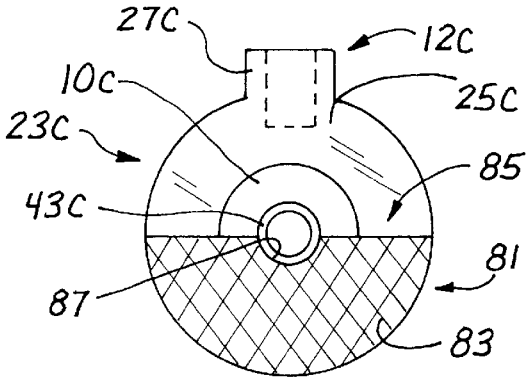
FIG. 6 is front elevation view similar to FIG. 2 and illustrating an embodiment including a basket.
Figure 7:
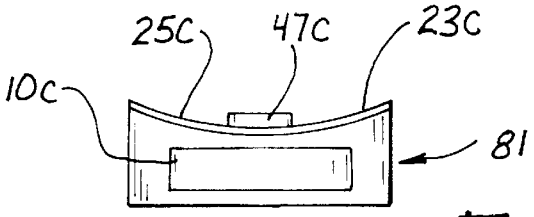
FIG. 7 is a top plan view taken along lines 7—7 of FIG. 6.

A further embodiment of the invention is illustrated in the front elevation view of FIG. 6 and the top-plan view of FIG. 7. In this embodiment, elements of similar structure are designated by the same reference numerals followed by the lower case letter "c". This carrier 12*c* differs from those previously discussed in that the hooks 34*a* and 63 are replaced by a basket 81 which can be attached to the backing plate 23*c*. The basket 81 can be formed from any wood, metal or plastic material, although in a preferred embodiment, it is formed as a mesh of wires 83. It is the purpose the basket 81 to form with the backing 23*c*, a container 85 of a size sufficient to receive the tape roll 10*c*. The backing plate 23*c*, including the support portion 27*c*, has a generally curved configuration. This enables the carrier 12*c* to conform to the anatomy of the person 14. For example, if the carrier 12 is to be attached to the hip pocket 18, the backing plate 23*c* might be curved to fit on the hip of the person 14.

The basket 81 can extend upwardly along the circular portion 25*c* of the backing plate 23*c* any distance sufficient to retain the tape roll 10*c* in the container 85. If this distance is greater than the radius of the tape roll 10*c,* it may be desirable to provide a circular cutout 87 in the basket 81 in order to facilitate access to the cylinder 43*c* associated with the tape roll 10*c*.

Notwithstanding the differences between the basket 81 and the hook 34, both of these structures function to retain the tape roll 10 relative to the backing 23. Of course, the hook 34 engages the inner cylinder 43 of the tape roll 10 while the basket 81 engages the entire tape roll 10 in the container 85.

Based on these and many other variation which will now be apparent, one is cautioned not to determine the extent of the concept only with reference to the disclosed and illustrated embodiments, but rather to determine the scope of the invention only with reference to the following claims.

What is claimed is:

1. A tape roll carrier adapted to be removably attached to apparel worn by a user, the tape roll carrier adapted to retain a tape roll having a particular shape and having at its core a cylinder, the tape roll carrier comprising:

a backing plate having a first side and an opposing second side;

a basket coupled to the first side of the backing plate, the basket having a bottom with a shape geometrically similar to the particular shape of the tape roll;

an attachment mechanism fixed to the backing plate and operable relative to the second side of the backing plate to engage the apparel worn by the user; and the basket comprises a circular cutout along a top edge of the basket to facilitate access to the cylinder of the tape roll.

2. The tape roll carrier recited in claim 1, wherein the basket comprises a mesh of wires.

3. The tape roll carrier recited in claim 1, wherein:

the backing plate comprises a first material; and the basket comprises a second material.

4. The tape roll carrier recited in claim 3, wherein the first material is the same as the second material.

* * * * *